United States Patent [19]

Johnson et al.

[11] Patent Number: 4,497,275

[45] Date of Patent: Feb. 5, 1985

[54] INK STAMP PAD AND RESERVOIR

[75] Inventors: Lewis H. Johnson, Mansfield; Lee A. Carlson, Southboro; David M. Lunt, Somerville, all of Mass.

[73] Assignee: Dennison Manufacturing Company, Framingham, Mass.

[21] Appl. No.: 536,132

[22] Filed: Sep. 26, 1983

Related U.S. Application Data

[63] Continuation-in-part of Ser. No. 407,367, Aug. 12, 1982, abandoned.

[51] Int. Cl.[3] ..... B05C 1/00

[52] U.S. Cl. ..... 118/268

[58] Field of Search ..... 118/264, 268, 266, 267; 521/52

[56] References Cited

U.S. PATENT DOCUMENTS

| | | | |
|---|---|---|---|
| 2,392,521 | 1/1946 | Chollar | 118/264 X |
| 2,777,824 | 1/1957 | Leeds | 521/52 |
| 3,861,619 | 12/1974 | Cofield, Jr. et al. | 118/264 X |

*Primary Examiner*—John P. McIntosh

*Attorney, Agent, or Firm*—Barry D. Josephs; George E. Kersey

[57] ABSTRACT

A composite stamp pad for coating a stamping device with ink. The composite stamp pad is composed of a porous ink pad with a porous reservoir liner. The porous reservoir absorbs any ink which may leak from the pad due to heat or high humidity. Ink absorbed into the reservoir flows back into the pad automatically when temperature or humidity return to moderate levels. The reservoir and ink pad each have an open cell structure wherein the average pore diameter of reservoir is at least about 10 micrometers greater than the average pore diameter of the pad.

16 Claims, 1 Drawing Figure

INK STAMP PAD AND RESERVOIR

BACKGROUND OF THE INVENTION

This application is a continuation-in-part of patent application Ser. No. 407,367 filed Aug. 12, 1982, now abandoned.

1. Field of the Invention

The present invention relates to stamp pads containing absorbed ink for use in reinking stamping devices.

2. Description of the Prior Art

The prior art discloses ink stamp pads composed of a porous fibrous or plastic material for absorbing a supply of ink therein. Conventional ink stamp pads are sold typically in metal containers or the like which may be closed in order to protect the pad when not in use. The ink pad is composed of a porous fibrous or plastic material having an open cell microporous structure with interconnecting capillaries. A supply of ink may be added to the porous pad after it is placed in the container, or the ink may be entrapped within the porous structure during formation of the pad itself.

These conventional ink stamp pads whether composed of fibrous or porous plastic material, while in common use, nonetheless have a well-known disadvantage. Although such ink stamp pads provide useful means for reinking ink stamping devices, the pads have a tendency to leak ink from the pad into the container under certain conditions. Leakage is dependent on the environmental conditions in which the pad is used or stored. Conditions that promote leakage include hot weather and high humidity. Since this problems of leakage has long been recognized in the field by user and supplier alike, manufacturers of such ink stamp pads have diligently tried for many years to produce a pad having no leakage under adverse climatic conditions of temperature and humidity. At the same time, it is undesirable to reduce the absorptive capacity of the pad. Although ink stamp pads have been improved over the years, no completely practical solution has been achieved.

In order to correct the leakage problem, the common focus of manufacturers of ink stamp pads and individuals skilled in the art has been to alter the porous structure of the pad, to resort to alternative pad materials, or to protect the pad from exposure to the adverse environmental conditions. Conventional processes exist for manufacture of ink stamp pads having an open cell pore structure such as that disclosed in U.S. Pat. No. 2,777,284 wherein the porous structure of the pad is formed during a plastic curing process, and ink becomes entrapped in the pores at the time of pore formation. Recently experimenters in the art have thought that, if less ink were entrapped in the pores during the curing step, the leakage problem could be solved. It was though that the ink could expand into unfilled pores as the ink absorbed moisture from the environment under high humid conditions. Unfortunately, it has been determined that when less ink is admixed into the resin dispersion from which the pad is formed, this produces a pad having smaller pore structure and at the same time less ink absorbed therein. The structure nonetheless is still saturated with ink. Alternative methods for correcting the leakage problem, such as sealing the ink pad with impervious packaging films, at best only retard the leakage problem when the pad is placed in storage but do not alleviate the problem when the pad is exposed during use. Also, if the pad is wrapped in such impervious packaging film the pad must be rewrapped or resealed after use, causing considerable inconvenience.

Similarly, focus has been placed on improving the design of the metallic container itself to make it moisture impervious and insulate the pad from high temperature environmental conditions. Although moisture tight metallic containers would help to retard the leakage problem, improving the container itself to the required degree would add considerably to the overall cost of the ink stamp pad and would not prevent the pad's exposure to high temperatures or high humid environmental conditions during use.

Accordingly, it is an object of the present invention to provide an ink stamp pad which does not leak during exposure to heat or high humid environmental conditions. A related object is that such leakage not occur either during periods of storage or periods of use.

It is another object of the invention to provide a highly absorptive ink stamp pad having an open porous structure.

A further object is to provide an ink stamp pad of simple design, which may be conveniently used.

SUMMARY OF THE INVENTION

The above and additional objects are achieved by providing an ink stamp pad consisting of a relatively thin porous reservoir liner in contact with the underside of the ink stamp pad preferably by fusing the liner to the pad. The porous liner is desirably of an open cell pore structure, having an average pore size which is greater than the average open cell pore size of the ink stamp pad. It has been determined that the average open cell pore size of the ink stamp is advantageously between about 5 to 50 micrometers; preferably, the average pore size of the ink stamp pad should be between about 10 to 30 micrometers; more preferably, between about 20 to 30 micrometers. The average open cell pore size of the liner is advantageously at least about 10 micrometers greater than the average open cell pore size of the ink pad. The average open cell pore size of the liner may desirably be as high as about 60 micrometers or slightly higher. If the average open cell pore size of the stamp pad is about 5 micrometers, the average pore size of the liner should preferably be between about 15 to 60 micrometers. If the average open cell pore size of the ink pad is about 50 micrometers, the liner's average pore size should be about 60 micrometers or slightly higher. At ink pad open cell pore sizes of about 10, 20, and 30 micrometers, the preferred range for the average pore size of the liner should desirably be between about 20 to 60 micrometers; 30 to 60 micrometers; and 40 to 60 micrometers, respectively.

The liner is placed in intimate contact with at least a major portion of the underside of the ink stamp pad and preferably is in intimate contact with the entire underside surface of the ink stamp pad. Advantageously, the liner is fused to the ink stamp pad during the manufacture of the ink stamp pad. The liner is either placed in intimate contact with the underside of the stamp pad or else fused thereto so that when the stamp pad is placed within the pad container the liner is positioned between the ink stamp pad and the closed bottom of the container.

When the relative pore sizes of liner and ink stamp pad are within the aforementioned ranges, although ink becomes entrapped in the porous structure of the pad during formation of the pad, essentially no ink becomes entrapped in the liner contacting the pad during the process of manufacture of the pad. The liner functions as an overflow reservoir into which ink may expand from the pad when the pad is exposed to elevated temperature or high humid conditions. The above-described combination of liner and pad has the unexpected function that, upon return to normal environmental conditions, e.g., less than about 70° F. or less than about 80 percent R.H., ink is reabsorbed into the pad from the liner. Thus, there is no leakage of ink from either pad or liner into the container. In order to achieve this result, the absorptive capacity of the liner should be sufficient to permit absorption of the maximum amount of ink which can leak from the stamp pad. Preferably, the liner should have an absorptive capacity such that it may readily absorb as much as about 25 percent of the weight of ink present in the ink stamp pad. Preferably, the liner is thinner than the stamp pad; typically, the liner has a thickness of about one tenth that of the stamp pad.

The liner should be composed of material which is temperature resistant and does not cause shrinkage, curling, or other deformation of the ink stamp pad during formation of the porous structure of the pad or later during use. Neither pad nor liner should be of elastomeric material. Although a pad composed of fibrous material may be employed, the present invention is principally directed to a combination of the liner with a pad formed of porous material having an open cell structure with interconnecting capillaries. A pad of the type, such as that disclosed in U.S. Pat. No. 2,777,824 may be made utilizing conventional resin and ink formulations. The combination of pad and liner is manufacturable by placing the liner first in the individual stamp pad container and then adding a resin dispersion and ink vehicle mix to coat the exposed liner surface. The resin dispersion and ink mix coating is then cured to form the porous ink pad with ink entrapped therein and fuses the liner to the pad. Alternatively, large sheets of liner may be coated with the resin dispersion containing suitable ink vehicle, and the coated liner heat cured to form an ink stamp pad and liner fused thereto. The fused material can then be cut into the desired sizes for inclusion in the ink stamp container.

Although the liner may be selected from a wide variety of materials, heat resistant fibrous materials, particularly fiberglass, provide an especially suitable material and is readily available with open cell pore structure having average pore diameter within the above-referenced ranges. The ink stamp pad not only provides an overflow reservoir for absorbing ink expelled by the stamp pad, but also permits ink captured by the liner to automatically return to the stamp pad as the environmental conditions become less hot or humid.

DETAILED DESCRIPTION

Figure 1:
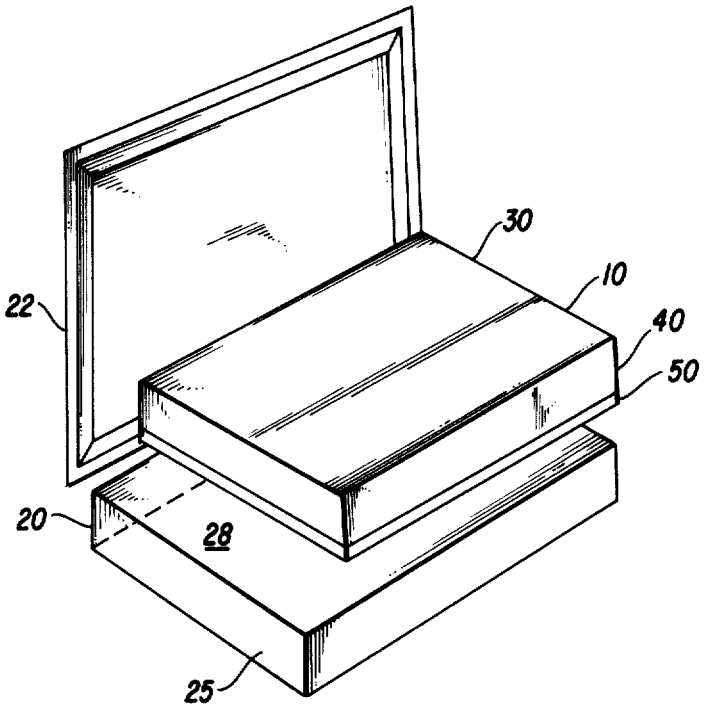
FIG. 1 is a perspective view of a composite stamp pad and container in accordance with the preferred embodiment, separated by components.

A preferred embodiment of the composite stamp pad of the invention with container is illustrated in FIG. 1. The composite stamp pad 10 includes an ink pad assembly 30, comprising pad 40 and an overflow reservoir liner 50 in intimate contact with the underside of ink pad 40. Liner 50 is also composed of an open cell microporous structure, and preferably is fused to at least a substantial portion of the underside of ink pad 40, most preferably, to the entire underside of ink pad 40. Ink pad assembly 30 may be placed in a conventional stamp pad container 20, typically a metallic container having a lid 22 which is easily opened and closed, and a container body 25.

Ink pad assembly 30 is positioned in the stamp pad container 20 such that the exposed surface of liner reservoir 50 contacts the bottom surface 28 of container body 25. Thus, when lid 22 is open the top surface of ink pad 40 is exposed to the environment. Ink pad 40 is advantageously loaded with a supply of ink contemporaneously with the manufacture of the pad itself. Typically, ink pad 40 is not reinkable. Liner reservoir 50 is preferably fused to ink pad 40 contemporaneously with the manufacture of ink pad 40, or alternatively may be fused to ink pad 40 in a separate step. When the composite stamp pad 30 is in place within container body 25, the user may coat the conventional stamping device with a fresh supply of ink by simply opening lid 22 and pressing the stamping device against the exposed surface of ink pad 40. Lid 22 is then reclosed to prevent dust from settling on the pad and to prevent ink from inadvertently being transferred from the pad to another object.

The average pore size of the ink stamp pad 40 should not be so small as to prevent adequate release of ink from the pad when a stamping device is pressed onto the pad. The average pore size of the ink stamp pad should, however, not be so large as to cause ink to be absorbed into the porous structure of reservoir liner 50 in amounts which would saturate liner 50 when placing the liner in intimate contact with the ink stamp pad as during the process of fusing the two together. Preferably, it is desirable that the reservoir liner 50 absorb as little ink as possible from ink pad 40 during the fusion process. (Pore size referred to herein is an average of the shortest diameters of open cell pores within ink pad or reservoir as specified.)

In accomplishing these and the aforementioned objectives of the invention, it has been determined that the average pore size of ink stamp pad 40 should desirably be between about 5 to 50 micrometers; preferably, the average pore size of ink stamp pad 40 should be between about 10 to 30 micrometers; more preferably, between about 20 to 30 micrometers. The average open cell pore size of reservoir liner 50 should be greater than the average open cell pore size of ink pad 40. Advantageously, the average pore size of liner 50 is at least 10 micrometers greater than the average pore size of ink pad 40. The average pore size of reservoir liner 50 may desirably be as high as 60 micrometers or slightly higher.

If the average pore size of the pad 40 is about 5 micrometers, the average pore size of the liner 50 should preferably be between about 15 to 60 micrometers. If the average open cell pore size of ink pad 40 is about 50 micrometers, the liner's average pore size should be about 60 micrometers or slightly higher. At intermediate porosities of ink pad 40 preferred ranges for the average pore size of the reservoir liner 50 are as follows. The average open cell pore size for the liner 50 desirably is between about 20 to 60 micrometers (more preferably, between about 20 to 40 micrometers) when the average pore size of the ink pad 40 is at about 10 micrometers; between about 30 to 60 micrometers (more preferably, 30 to 50 micrometers) when the average pore size of the ink pad is about 20 micrometers; and between about 40 to 60 micrometers when the average pore size of the ink pad 40 is about 30 micrometers. Applicant has determined that when the aforementioned average pore size ranges and relationships are achieved, liner reservoir 50 will absorb ink which may leak from ink pad 40. Ink may leak from pad 40 in warm or humid environments, for example at temperatures over 80° F. or relative humidities above 80 percent, as well as at both temperatures over 80° F. and relative humidities above 80 percent. A reservoir liner 50 having the above-discussed relative pore size not only absorbs ink which may leak from pad 40, but also returns the ink automatically to ink pad 40 when the environmental conditions of temperature and humidity are reduced to more moderate levels. For example, if ink leaks from pad 40 into liner 50 as a result of environmental temperature reaching above about 80° F., ink will automatically return to pad 40 from liner 50 when temperature conditions fall below about 70° F. Similarly, if ink leaks from pad 40 into liner 50 as a result of the relative humidity rising above about 80 percent, ink will automatically return to pad 40 from liner 50 when the relative humidity falls below about 80 percent. Additionally, if ink leaks from pad 40 into liner 50 as a result of environmental conditions climbing to both above about 80° F. and relative humidity above about 80 percent, ink will automatically return to pad 40 from liner 50 if the environmental temperature drops to below about 70° F., or alternatively, if the relative humidity drops to below about 80 percent as well as if both temperature drops below about 70° F. and relative humidity drops below about 80 percent.

In addition to these dual functions of reservoir liner 50, applicants have determined, quite unexpectedly, that when the average pore size of liner 50 and ink pad 40 are within the ranges and have the size relationship above described, liner 50 does not absorb more than negligible amounts of ink during the preferred process of fusing liner 50 to an ink saturated pad 40. This ensures that liner 50 will effectively absorb any ink which may leak from ink pad 40 at a later time. In the preferred fusion process, liner 50 and the ink saturated pad 40 may be exposed to elevated temperatures on the order of about 150° C. for an interval up to about 10 minutes.

Ink pad 40 is formed of a microporous plastic material having an open cell pore structure with entrapped ink therein. A porous ink pad of this type may be made by methods of the type disclosed in U.S. Pat. No. 2,777,824. Applicant has determined that a nonelastomeric reservoir liner 50 may be conveniently fused to ink pad 40 during formation of ink pad 40 in which process a resin dispersion forming ink pad 40 with ink entrapped therein is exposed to elevated temperatures of between about 140°–160° C. for about 5–10 minutes. If the liner 50 is fused to ink pad 40 as the pad itself is being formed, then liner 50 must not be so absorptive as to absorb more than very slight amounts of ink from ink pad 40 during the pad formation and liner fusion process. Applicant has further determined that the minimum thickness of liner reservoir 50 is preferably 1/10 the thickness of ink pad 40. Ink pad 40 is illustratively about 0.2 inches thick and may typically be in a range of thickness between about 0.1 to 0.4 inches. The overall amount of exposed surface area of ink pad 40 may typically be about 12 square inches.

The resin dispersion used in formulating composite pad 30 may be composed of nonelastomeric, thermoplastic resins such as polyvinylchloride, polyvinyl acetate, polyvinyl butyral, or polyvinyl ethylene. Typically, a resin dispersion is first made composed of resin and plasticizer such as dioctyl pthalate. A stabilizer may be added to the resin and plasticizer. To this dispersion an ink mix composed of ink and ink vehicle may be added forming a resin/ink dispersion. The ink vehicle typically is ethyl hexanediol, and the ink may be methyl violet. The microporous structure of the ink pad 40 is formed during the curing stage wherein the resin fuses to form a rigid plastic material. The ink vehicle is sufficiently incompatible with the fused resin that the mixture results in an open cell microporous structure with ink entrapped therein. Although materials and method for forming such an open porous ink pad are described in U.S. Pat. No. 2,777,824, applicant discloses a preferred ink vehicle and resin mix in the ensuing example.

Applicant has determined that the liner 50 can be made to fuse to ink pad 40 as the ink pad 40's microporous structure is formed. After liner reservoir 50 fuses to ink pad 40 and the ink pad 40 is sufficiently cured to form the required microporous open cell structure saturated with ink, the composite stamp pad 30 thus formed may be cut into slabs and placed directly into container body 25. Alternatively, the composite stamp pad 30 may be formed by first placing a slab of liner reservoir 50 in contact with the bottom surface 28 of container body 25, and then pouring the resin/ink dispersion onto liner 50. The thus coated liner 50 within stamp pad container body 25 may then be cured while in the container until the ink pad 40 having the desired microporous structure saturated with ink is formed and liner reservoir 50 becomes fused thereto.

Elastomeric materials, i.e. materials classified in the polymer chemical art as elastomers (rubbers) are not suitable materials for ink pad 40 or liner reservoir 50. If either (or both) pad 40 or liner reservoir 50 were formed of elastomers, i.e. rubber polymers, the required degree of porosity could not be maintained without deformation as pad 40 and liner 50 are subjected to the necessary processing for simultaneous manufacture of the pad and fusion of the liner thereto.

Liner 50 should be of a nonelastomeric composition which is heat resistant and does not perceptibly shrink, expand, or deteriorate when exposed to elevated process conditions up to about 160° C. Materials having suitable heat resistant characteristics encompass a wide variety of nonelastomeric materials. However, applicant has determined that heat resistant fibrous materials, particularly fiberglass, are especially suitable for liner 50. A preferred fiberglass material which is commercially available in the range of pore size which is suitable for use in the present invention is sold under the tradename Craneglas 200 series, e.g. Craneglas 200, 210, 230 and 240 available from Crane & Co., Inc. Nonwoven Products Div., Dalton, MA. In particular, a desired relationship between pore size diameter of the liner and that of the ink pad is achievable when Craneglas 230 fiberglass is used for liner 50, and when ink pad 40 made generally in accordance with the specifications set forth in the following examples is employed. The resin should be in particulate form having an average particle diameter between about 0.2 microns and as high as between about 25–100 microns, preferably average particle diameter of the resin is between 0.2–2 microns average diameter.

An example illustrative of the method of manufacture of the composite stamp pad of the invention is set forth as follows.

EXAMPLE ONE 100 parts of polyvinyl chloride resin having a dispersion grade average particle diameter in the range 0.2–2 microns and 100 parts by weight dioctyl phthalate was mixed with a high speed dispersion mixer to form a homogeneous resin dispersion. To this resin dispersion was added 100 parts by weight of an ink mixture composed of 10 parts by weight nigrosine base ink and 90 parts by weight 1.5 pentane diol ink vehicle. The ink was stirred into the resin dispersion with high speed mixers until a homogeneous resin/ink dispersion is achieved. After the resin/ink dispersion had been formed, it was passed through a Versator deaerator to remove any entrapped air from the dispersion.

The resin/ink dispersion was then poured directly onto a sheet of Craneglas 230 nonwoven fiberglass web liner. The thus coated fiberglass web liner was passed through a convective oven operating at about 140°–160° C. for a period of about 5–10 minutes, until sufficient curing of the resin was achieved. As the resin cured, the incompatible ink vehicle separated from the resin, and a rigid plastic ink pad was formed having an open pore structure with interconnecting channels. Simultaneously upon formation of the ink pad porous structure the nigrosine based ink became entrapped in the pores as the pores were formed. As the microporous structure of the ink pad was formed entrapping ink therein, the fiberglass liner became fused to the underside of the ink pad which was in contact with the liner. Substantially or virtually all of the pores within the liner were devoid of any ink.

EXAMPLE TWO

A composite stamp pad was fabricated in accordance with EXAMPLE ONE, with the following modification. The fiberglass web liner was precut into 4"×2.5" rectangles and inserted into the flat metal containers. The ink/resin dispersion of Example One was then poured over the liner in a uniform layer. The coated liners housed in metal containers were passed through a convective oven as in the above example to cure the coated liner materials and form a microporous ink pad with fused liner. The composite pads provided effective ink absorption without noticeable leakage as in Example One.

While the present invention has been described with reference to preferred materials for the liner as well as preferred composition for the ink pad, it should be appreciated that wide variations in compositions for both liner and ink pad are possible without departing from the scope of the present invention. Liner and ink pads of different or varying compositions will also be suitable provided they fall within the disclosed range of relative porosities and meet the general physical requirements set forth in the specification. The invention therefore is not intended to be limited by the specific embodiments disclosed, but rather is defined by the scope of the claims and equivalents thereof.

We claim:

1. A composite ink pad comprising:

a porous pad comprising a thermoplastic, nonelastomeric resin having a microporous open cell structure housing a quantity of ink; and a nonelastomeric reservoir liner in substantial contact with one side of said ink pad, said reservoir liner having a microporous open cell structure, wherein the average pore diameter of the reservoir liner is greater than the average pore diameter of the ink pad, said reservoir liner capable of absorbing at least a portion of ink leaking from said pad when the pad is exposed to at least one of the two following conditions:

(a) elevated ambient temperature higher than about 80° F, (b) elevated humidity higher than about 80 percent humidity;

said reservoir liner permitting the porous pad to reabsorb at least a portion of said ink from the liner upon reexposure of the pad to at least one of the two following normal ambient conditions:

(a) ambient temperature less than about 70° F.;

(b) humidity less than about 80 percent relative humidity.

2. A composite ink pad as in claim 1 wherein the average pore diameter of the liner is at least 10 micrometers greater than the average pore diameter of the ink pad.

3. A composite ink pad as in claim 2 wherein the reservoir liner is fused to a substantial portion of at least one side of the ink pad.

4. A composite ink pad as in claim 3 wherein the reservoir liner becomes fused to the ink pad simultaneously with formation of the open cell pores in said ink pad.

5. A composite ink pad as in claim 4 wherein the open cell pores in the ink pad are formed by the process of:

coating onto the reservoir liner a resin-ink dispersion comprising a thermoplastic resin having an average particle diameter between about 0.2 and 100 microns, a plasticizer, and an ink mixture comprising an ink pigment and ink vehicle, said ink vehicle being noncompatible with the thermoplastic resin, and heating the resin-ink coating and reservoir liner to form a rigid structure fused to said reservoir liner.

6. A composite ink pad as in claim 5 wherein the average particle diameter of the resin is between about 0.2 and 25 microns.

7. A composite ink pad as in claim 2 wherein the average pore diameter of the ink pad is in a range between about 5 to 50 micrometers.

8. A composite ink pad as in claim 7 wherein the average pore diameter of the ink pad is in a range between about 10 to 30 micrometers.

9. A composite ink pad as in claim 7 wherein the average pore diameter of the reservoir liner is as high as about 60 micrometers.

10. A composite stamp pad as in claim 1 wherein the reservoir liner can absorb up to about 25 percent by weight of ink present in the ink pad.

11. A composite stamp pad as in claim 1 wherein the reservoir liner is thinner than the stamp pad.

12. A composite stamp pad as in claim 11 wherein the stamp pad has a thickness of between about 0.1 and 0.4 inches.

13. A composite stamp pad as in claim 1 wherein the reservoir liner comprises heat resistant material which does not shrink, expand, or deteriorate when exposed to elevated temperatures up to about 160° C.

14. A composite stamp pad as in claim 13 wherein the reservoir liner comprises a fibrous material.

15. A composite stamp pad as in claim 14 wherein the reservoir liner comprises fiberglass.

16. A composite ink pad comprising:

a porour pad comprising a thermoplastic, nonelastomeric resin having a microporous open cell structure housing a quantity of ink; and a nonelastomeric reservoir liner in substantial contact with one side of said ink pad, said reservoir liner having a microporous open cell structure, wherein the average pore diameter of the reservoir liner is greater than the average pore diameter of the ink pad;

the average pore diameter of the ink pad being in a range between about 5 to 50 micrometers, the average pore diameter of the reservoir liner being at least 10 micrometers greater than the average pore diameter of the ink pad, and the average pore diameter of the reservoir liner having a maximum value of about 60 micrometers;

said reservoir liner capable of absorbing at least a portion of ink leaking from said pad when the pad is exposed to at least one of the two following conditions:

(a) elevated ambient temperature higher than about 80° F.;

(b) elevated humidity higher than about 80 percent humidity;

said reservoir liner permitting the porous pad to reabsorb at least a portion of said ink from the liner upon reexposure of the pad to at least one of the two following normal ambient conditions:

(a) ambient temperature less than about 70° F.;

(b) humidity less than about 80 percent relative humidity.

* * * * *